United States Patent [19]

Hinds

[11] 4,443,671

[45] Apr. 17, 1984

[54] FLOW SENSOR

[75] Inventor: Edward T. Hinds, Fond du Lac, Wis.

[73] Assignee: Brunswick Corporation, Skokie, Ill.

[21] Appl. No.: 335,016

[22] Filed: Dec. 28, 1981

[51] Int. Cl.[3] ..... H01H 35/24

[52] U.S. Cl. ..... 200/81 R; 200/81.9 R; 340/606

[58] Field of Search ..... 200/81.9 R, 81 R, 81.9 M, 200/83 Q, 83 S, 83 N; 340/603, 606, 610, 611

[56] References Cited

U.S. PATENT DOCUMENTS

| | | | |
|---|---|---|---|
| 1,619,103 | 3/1927 | Doman | 200/81 R |
| 1,693,309 | 11/1928 | Mettler | 200/81.9 R |
| 2,495,443 | 1/1950 | Castellano | 200/81 H |
| 2,558,235 | 6/1951 | Castellano | 200/81 H |
| 3,293,389 | 12/1966 | Von Bhicknapahari | 200/81.9 R |
| 3,689,719 | 9/1972 | Phillips et al. | 200/83 N |
| 3,814,877 | 6/1974 | Alvarez | 200/81.9 R |
| 4,000,386 | 12/1976 | Brouwer | 200/83 N |
| 4,297,552 | 10/1981 | Lauritsen et al. | 200/83 S |

*Primary Examiner*—J. R. Scott

*Attorney, Agent, or Firm*—O. T. Sessions

[57] ABSTRACT

The invention provides a flow sensor (10) for providing an electrical output indicating a no flow condition, an intermediate flow rate, and a high flow rate and is particularly suited for sensing the flow of lubricant to a two-cycle engine. The flow sensor (10) includes a metallic reed valve member (22) which contacts a valve seat (28) to provide a no flow signal or an adjustable contact member (31) to provide a high flow signal. The reed valve member (22) contacts neither the valve seat (28) nor the contact member (31) to indicate an intermediate flow rate.

5 Claims, 3 Drawing Figures

FLOW SENSOR

DESCRIPTION

1. Technical Field

This invention relates to fluid flow sensors and particularly to such sensors for providing an electrical output indicating a no flow condition, the presence of flow, and a high flow rate.

2. Background Art

In two-cycle engines which use a pump to supply lubricant from a separate supply tank to mix with fuel and provide lubrication for the engine, it is essential that the engine not be run if the lubricant supply is interrupted. In a typical high performance engine for an outboard motor the lubricant flow rate would range from less than one cc per minute. In such systems it is desirable to provide a sensor which is both inexpensive and reliable to detect interruption of the lubricant supply.

DISCLOSURE OF INVENTION

In accordance with the present invention a flow sensor for limiting fluid flow to a single direction and providing electrical signals indicating a no flow condition, an intermediate flow condition, and a high flow condition is provided. The flow sensor includes a body formed of an electrically insulating material, a valve seat member mounted on the body and having a passage therethrough, and a valve member biased to close the passage. First and second electrical contacts are attached to the body. A third electrical contact is attached to the valve member to make electrical contact when the valve member closes the flow passage and with the second electrical contact when flow through the passage is at a predetermined level.

The valve member may conveniently be a reed valve having one end attached to the sensor body and may be formed from an electrically conducting material to function as the third electrical contact. The valve seat member may also be formed of an electrically conducting material to serve as the first electrical contact.

Preferably the flow sensor includes a means for adjusting the position of the second contact to allow the device to be calibrated to provide a signal at the desired flow rate. In the preferred embodiment the second contact is positioned directly opposite the valve seat member to avoid any unnecessary stressed on the reed valve member when it is in contact with the second contact.

BEST MODE FOR CARRYING OUT THE INVENTION

Figure 1:
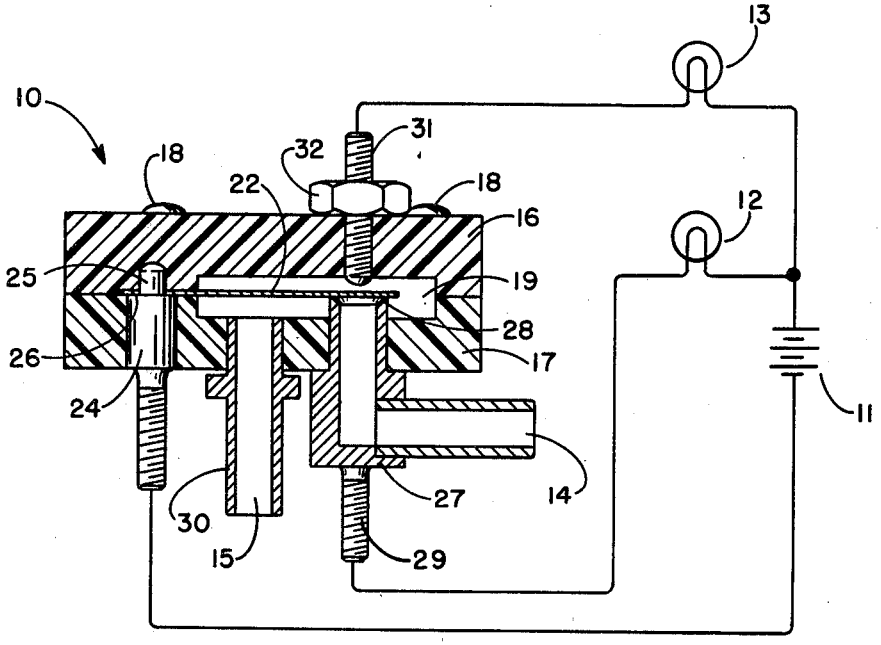
FIG. 1 is a sectional view of a flow sensor according to the invention, schematically showing its inclusion in an electrical circuit.
Figure 2:
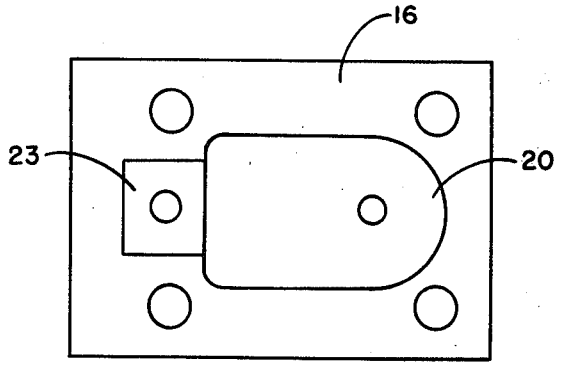
FIG. 2 is an internal view of the lower section of the sensor.

Referring to the drawings, FIG. 1 shows a flow sensor 10 according to the invention connected in circuit with a battery 11 and two indicator lights 12 and 13. The sensor 10 is intended for use in the lubricant supply line of a two-cycle engine to provide indications of proper operation of the lubricant system. Particularly, the sensor 10 is intended to have its inlet 14 connected to the discharge line of a lubricant pump and to have its outlet 15 connected to supply lubricant to the engine.

The body of the sensor 10 is made in two segments 16 and 17 which are joined together by rivets 18 to form a valve chamber 19 and is formed of an electrically insulating material which is impervious to oil and water, such as a Nylon II material. The valve chamber 19 is formed by mating recessed portions 20 and 21 in the two segments 16 and 17.

Figure 3:
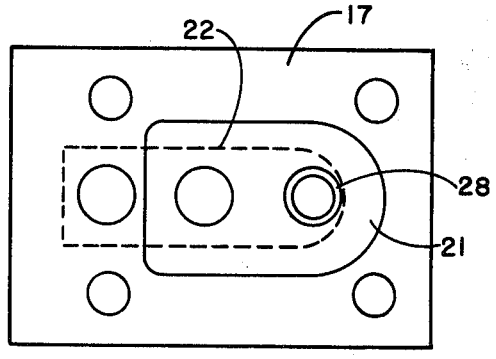
FIG. 3 is an internal view of the upper section of the sensor.

A reed valve member 22, shown in dotted lines in FIG. 3, has one end sandwiched between the two sensor body segments 16 and 17 and projects into the valve chamber 19 along the joining plane of the two segments 16 and 17. A small recess 23 in the upper segment 16 of the sensor body holds the valve member 22 in alignment and electrical contact with the valve member 22 is provided by a terminal 24 pressed into the lower segment 17. The terminal has a pin 25 on its inward end which passes through a hole in the valve member 22. A shoulder 26 on the terminal assures electrical contact with the reed 22. A reed valve member 22 is formed of a hardened Beryllium Copper alloy and is approximately 0.003 inches thick.

The inlet to the valve chamber 19 is provided by a metallic inlet fitting 27 pressed into the lower segment 17 of the sensor body. The inlet fitting 27 projects into the valve chamber 19 and has a valve seat 28 formed on its inner end. The valve seat 28 lies in the same plane with the joining line of the two sensor body segments and is conically shaped to minimize the contact area with the reed valve member 22, thereby assuring electrical contact with the reed valve member 22. A threaded stud 29 is provided on the outside of the inlet fitting 27 to provide an electrical terminal. An outlet fitting 30 is pressed into the lower segment 17 of the sensor body beneath the reed valve member 22. An adjustable contact member 31 is attached to the upper segment 16 of the sensor body by screw threads and locked into position by a lock nut 32. The contact member 31 is aligned with the valve seat 28 on the inlet fitting to prevent unnecessary distortion of the reed valve member 22 when the valve member 22 contacts the contact member 31.

In operation the terminal 24 attached to the valve member 22 is connected to one side of a power source such as a battery 11. The other side of the battery is connected through a first indicator light 12 to the terminal 29 on the inlet fitting 27 and through a second indicator light 13 to the adjustable contact member 31. When no lubricant is flowing through the sensor 10, the reed valve member 22 will be in contact with the valve seat 28, thereby closing the circuit to light the first indicator light 12. When the engine begins operation, the oil pump supplies lubricant to the inlet fitting 27 and thereby to the engine, thus lifting the valve member 22 off the valve seat 28 and opening the circuit to the first indicator light 12. As the engine increases speed the reed valve member 22 will open further until it contacts the adjustable contact member 31. The sensor 10 will thus close the circuit to light the second indicator light 13 and show that adequate lubricant is being supplied to the engine during high speed operation. Should the lubricant supply be interrupted the valve member 22 will close the valve and show that no flow is passing through the sensor. Of course, an additional indicator light could be provided to show normal operation in the intermediate speed range. The additional light could easily be controlled by a simple logic function such as an AND gate.

The sensor 10 further acts as a check valve to assure that lubricant is maintained in the supply line between the sensor and engine when the engine is not operating. Thus when the engine is started there will be no time lag before lubricant is supplied to the engine.

I claim:

1. A flow sensor for limiting fluid flow to a single direction and providing electrical signals indicating a no flow condition, and intermediate flow condition, and a high flow condition, comprising;

(A) a body formed of an electrically insulating material;

(B) a valve seat member mounted on said body and having a flow passage therethrough, said valve seat member formed of an electrically conducting material to function as a first electrical contact;

(C) a second electrical contact attached to said body; and (D) a reed valve member having a first end attached to said body and second free end biased to close said passage, said reed valve member formed from an electrically conducting material to function as a third electrical contract for making electrical contact with said first electrical contact when said valve member closed said flow passage and for making electrical contact with said second electrical contact when flow through said passage reaches a predetermined level.

2. The flow sensor defined in claim 1 further comprising adjustment means for positioning said second electrical contact.

3. The flow sensor defined in claim 2 wherein said second electrical contact is positioned directly opposite said valve seat member.

4. A flow sensor for limiting fluid flow to a single direction and providing electrical signals indicating a minimum flow condition, an intermediate flow condition, and a high flow condition, comprising;

(A) a sensor body formed of an electrically insulating material and having a chamber, a flow inlet, and a flow outlet to said chamber;

(B) an electrically conductive valve seat member on said flow inlet, and having a first electrical terminal atached thereto;

(C) an electrical contact mounted in said chamber opposite said valve seat member; and (D) an electrically conductive reed valve member supported in said sensor body between said valve seat member and said electrical contact to normally contact said valve seat member and close said flow inlet, said reed valve member having a second electrical terminal attached thereto, said reed valve member having one end attached to said sensor body;

whereby a closed circuit is established between said first and second terminals when no flow is passing through said sensor body, a closed circuit is established between said second electrical terminal and said electrical contact when a high flow rate is passing through said sensor body, and an open circuit is established between said second electrical terminal and both of said first terminal and said electrical contact when an intermediate flow rate is passing through said sensor body.

5. The flow sensor defined in claim 4, wherein said electrical contact is adjustably positioned in said chamber.

* * * * *